US006297775B1

(12) United States Patent
Haws et al.

(10) Patent No.: US 6,297,775 B1
(45) Date of Patent: Oct. 2, 2001

(54) COMPACT PHASED ARRAY ANTENNA SYSTEM, AND A METHOD OF OPERATING SAME

(75) Inventors: James L. Haws, McKinney; Byron Elliott Short, Jr., Fairview, both of TX (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/397,486

(22) Filed: Sep. 16, 1999

(51) Int. Cl.[7] ..... H01Q 1/38
(52) U.S. Cl. ..... 343/700 MS; 343/853
(58) Field of Search ..... 343/700, 853; 165/80.4, 168

(56) References Cited

U.S. PATENT DOCUMENTS

| | | | |
|---|---|---|---|
| 4,250,958 | 2/1981 | Wasserman | 165/46 |
| 4,673,030 | 6/1987 | Basiulis | 165/32 |
| 5,085,790 | 2/1992 | Hormansdorfer | 252/70 |
| 5,272,491 | 12/1993 | Asakawa et al. | 346/140 R |
| 5,293,171 | 3/1994 | Cherrette | 343/700 MS |
| 5,386,701 | 2/1995 | Cao | 62/259.3 |
| 5,579,830 | 12/1996 | Giammaruti | 165/104.27 |

*Primary Examiner*—Don Wong
*Assistant Examiner*—James Clinger
(74) *Attorney, Agent, or Firm*—Baker Botts L.L.P.

(57) ABSTRACT

An antenna system (10) includes circuitry (13) and an antenna unit (12). The antenna unit includes a multi-layer circuit board (21). The circuitry provides radio frequency signals, control signals and power to the circuit board. The circuit board has an array of antenna elements (23) on one side thereof, and has a plurality of modules (71, 72) soldered to and projecting outwardly from the opposite side thereof. The modules each have electronic circuitry thereon, which is electrically coupled to the circuit board. Each module includes a thermal transfer element (96), the heat generated by the electronic components on that module being thermally transferred by the thermal transfer element to a cooling section (51).

26 Claims, 2 Drawing Sheets

COMPACT PHASED ARRAY ANTENNA SYSTEM, AND A METHOD OF OPERATING SAME

TECHNICAL FIELD OF THE INVENTION

This invention relates in general to an antenna system and, more particularly, to a compact phased array antenna system suitable for use in a satellite, and a method of operating such an antenna system.

BACKGROUND OF THE INVENTION

Active phased array antenna systems are used in a wide variety of applications. As one example, a satellite may include an antenna system of this type in order to facilitate communication between the satellite and one or more ground stations on earth. In a phased array antenna system, especially for a satellite, it is desirable that the antenna system be relatively small in volume and relatively light in weight. On the other hand, antenna systems of this type typically use circuits such as monolithic microwave integrated circuit (MMICs). Circuits such as MMICs generate a substantial amount of heat during operation. As the frequency of antenna operation increases, there is an increase in the amount of heat which is emitted by these circuits, which in turn can affect temperature gradients across the array.

In particular, in a phased array antenna system, the existence of temperature gradients across the array can produce phase errors, which affect the accuracy of the antenna system. The higher the frequency of antenna operation, the smaller the permissible temperature gradients across the array. For example, where the phased array is operating at a frequency of about 5 GHz, the maximum allowable temperature gradient across the array is about 20° C. In contrast, when the array is operating at a frequency of about 80 GHz, the maximum allowable temperature gradient across the array is only about 1.3° C. If the maximum temperature gradient across the array cannot be kept below the maximum allowable gradient, then it is necessary to provide additional circuitry in the antenna system to effect dynamic phase error control compensation, which increases the complexity, cost and weight of the antenna system. Thus, it is important to have an efficient technique for cooling the circuitry of the antenna system, so that a substantially uniform temperature is maintained across the array.

One traditional phased array antenna system has a configuration commonly known as an array slat arrangement, and uses forced flow of a liquid coolant. However, the thickness, volume and weight of this arrangement are greater than desirable, and the forced flow of the liquid coolant requires hardware for handling the coolant, which increases the effective volume and weight of the overall antenna system.

A different approach, which is more recent, is commonly known as a tile array, and uses a multi-layer circuit board. The circuit board has the antenna elements and the circuit components of the antenna system mounted thereon, and cooperates with a relatively thin cooling arrangement. This has the advantage of being ultra thin and low in weight, and also provides shorter conductors for radio frequency signals than the traditional array slat approach. However, while this known approach has been generally adequate for its intended purpose, it has not been satisfactory in all respects.

More specifically, the ultra thin configuration makes it difficult or impossible to use radio frequency circulators and/or isolators, as a result of which a given antenna system is typically configured to either send or receive signals, but not both. Further, only a limited amount of circuitry can be provided directly on the multi-layer circuit board within the size limits of the antenna element array, even where some of the circuit components are mounted in a stacked or "piggy-back" arrangement. As a result, it is difficult to provide multi-beam capability in an antenna system. A further consideration in such ultra thin antenna configurations is that it is typically difficult to separately optimize the cooling system and the packaging of the radio frequency circuitry, because the compactness of the system causes various design aspects to become interdependent. A further consideration in these ultra thin antenna systems is that, since various circuit components are provided directly on the multi-layer board, problems can occur as a result of different coefficients of thermal expansion.

SUMMARY OF THE INVENTION

From the foregoing, it may be appreciated that a need has arisen for an antenna system, and a method of operating it, which involve a compact and lightweight system, which allow the use of isolators or circulators, which allow the implementation of multiple beam capability within the size limits of the antenna element array, which permit independent optimization of the cooling section and the radio frequency circuitry, which avoid problems due to different coefficients of thermal expansion, which provide relatively short conductors for radio frequency signals, and/or which effect cooling in a manner sufficiently efficient to maintain a substantially uniform temperature across the entire array.

According to the present invention, an antenna system and a method of operation are provided in order to address this need, and involve: providing an electrical interconnection section which is thin and generally planar; arranging on one side of the interconnection section an antenna section which includes a plurality of antenna elements that are each electrically coupled to the interconnection section; supporting a cooling section at a location which is spaced from the interconnection section on a side thereof opposite from the antenna section; providing between the interconnection section and the cooling section a module which has electronic components thereon; transmitting electrical signals between the electronic components and the interconnection section; and transferring to the cooling section the heat emitted by the electronic components.

BRIEF DESCRIPTION OF THE DRAWINGS

A better understanding of the present invention will be realized from the detailed description which follows, taken in conjunction with the accompanying drawings, in which.

DETAILED DESCRIPTION OF THE INVENTION

Figure 1:
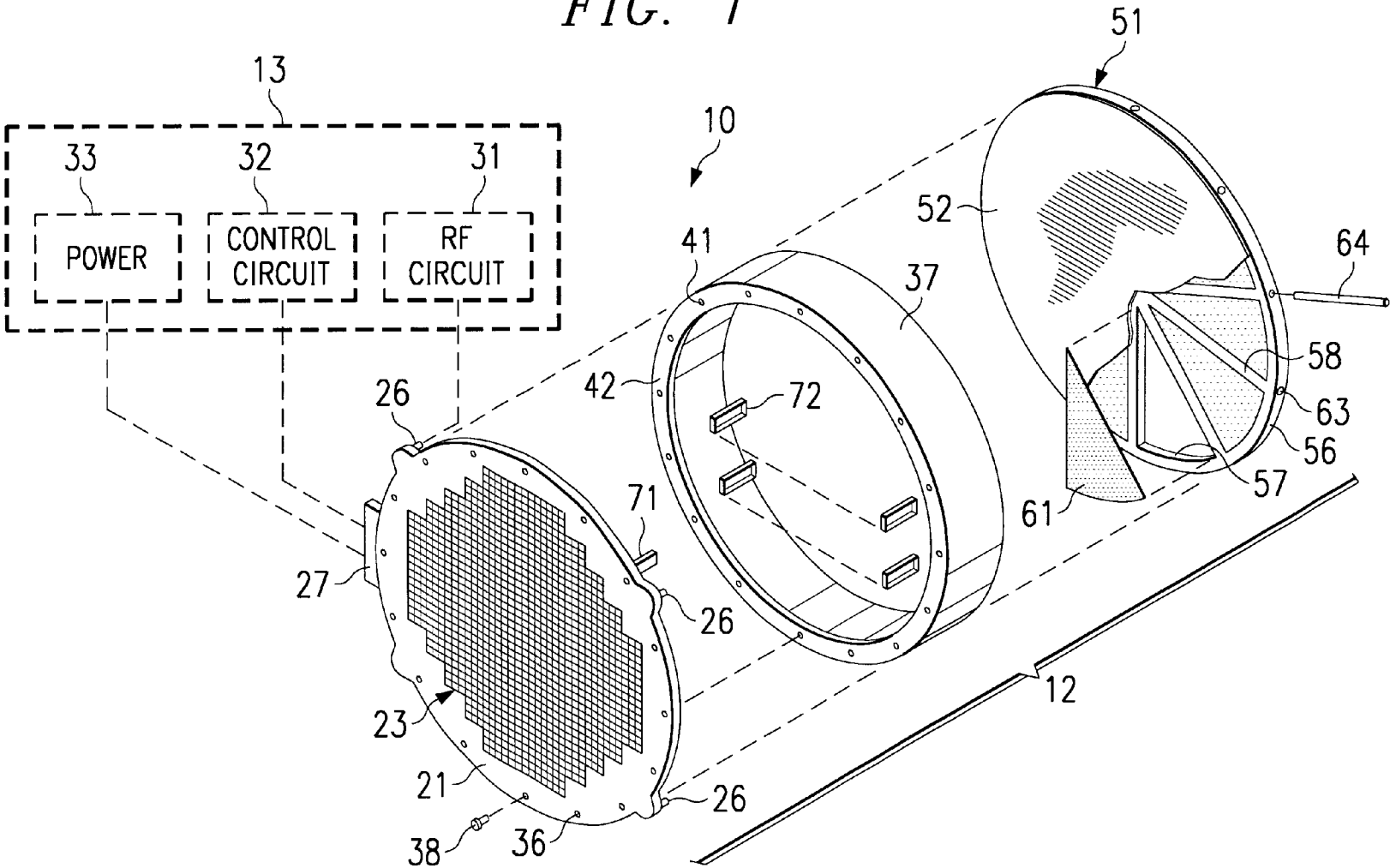
FIG. 1 is a diagrammatic perspective view of an antenna system which embodies the present invention, including an antenna unit which shown in an exploded form for clarity.

FIG. 1 is a diagrammatic perspective view of an antenna system 10, including an antenna unit 12, and circuitry 13 which is operatively coupled to the antenna unit 12. The antenna unit 12 is shown in an exploded form in FIG. 1 for purposes or clarity. The exemplary embodiment disclosed in FIG. 1 is an antenna system of the type commonly known as an active phased array antenna system.

The antenna unit 12 includes a multi-layer circuit board 21. The circuit board 21 is generally planar, and in the disclosed embodiment is generally circular, although it could have some other shape, such as a square. The circuit board 21 serves as an interconnection section for providing electrical interconnections between various component parts of the system, as discussed in more detail later. In the disclosed embodiment, the circuit board 21 has about twenty-nine layers, but it could have a larger or smaller number of layers without departing from the subject matter of the present invention.

An array of antenna elements 23 is provided on one side of the circuit board 21. In the disclosed embodiment, the antenna elements 23 are patch antenna elements formed by an appropriate patterned etch of a metalization film disposed directly on one side of an outer layer of the circuit board 21. However, the antenna elements 23 do not have to be supported directly on the circuit board 12, and could instead be provided thereon in some other manner. Further, the antenna elements 23 could have some other configuration. For example, they could be waveguide elements, rather than patch elements.

The circuit board 21 has four radio frequency (RF) connectors 26, three of which are visible in FIG. 1. These four connectors 26 are each provided adjacent the peripheral edge of the circuit board 21, at locations which are uniformly circumferentially spaced. The RF connectors 26 each project outwardly on a side of the circuit board 21 opposite from the antenna elements 23. The antenna unit 12 is a four-beam antenna system, and each of the RF connectors 26 corresponds to a respective one of the four beams. The circuit board 21 also has mounted thereon a power and logic connector 27, at a location on the periphery which is between two of the connectors 26.

The circuitry 13 includes an RF circuit 31, which is coupled by four separate cables to each of the four respective RF connectors 26, one of these cables being represented diagrammatically in FIG. 1 by a broken line. The circuitry 13 further includes a control circuit 32 and a power circuit 33, which are both coupled to the power and logic connector 27. The power circuit 33 provides the antenna unit 12 with direct current (DC) power, and the control circuit 32 provides the antenna unit 12 with digital logic signals that represent control information such as commands which indicate directions in which the antenna 12 should scan.

The circuit board 21 has a plurality of small openings 36 therethrough at uniformly spaced locations along its peripheral edge. Adjacent the circuit board 21 is an annular housing 37, which has at the end nearest the circuit board a radially inwardly projecting annular flange. The circuit board 21 is secured to the annular housing 37 by a plurality of bolts 38, which each extend through a respective one of the openings 36, and each engage a respective threaded opening 41 provided in the annular flange, the openings 41 being located at uniformly circumferentially spaced locations along the annular flange 42.

The housing 37 is made of a material having a low coefficient of thermal expansion (CTE), for reasons discussed later. In the disclosed embodiment, the housing 37 is an epoxy graphite material, but it could be some other material with a low CTE. The housing 37 is disposed on a side of the circuit board 21 opposite from the antenna elements 23. A cooling section 51 is fixedly secured to the axial end of the housing 37 remote from the circuit board 21. For example, the housing 37 may be brazed or welded to a face plate 52 of the cooling section 51. The face plate 52 is made from a material which is highly thermally conductive, such as aluminum.

The particular cooling section shown at 51 in FIG. 1 represents one type of cooling section which is suitable for use according to the present invention. This particular cooling section 51 is a phase change module. It includes a circular base member 56 which is made of a thermally conductive material such as aluminum, and which has a plurality of approximately triangular recesses 57 machined into one side thereof. The recesses 57 define radially extending ribs 58, which are disposed between the recesses 57.

An approximately triangular piece of porous material 61 is disposed in each of the recesses 57. The porous material 61 is a thermally conductive material, and may for example be a material of the type commonly known as aluminum foam. A suitable porous material is available commercially as DUOCEL foam (40 PPI, 6–8%, 6101-T6) from ERG Materials and Aerospace Corporation of Oakland, Calif. The remaining space in each of the recesses 57 is filled with a not-illustrated phase change material, which in the disclosed embodiment is a commercially available material, commonly known as a phase change wax. The circular face plate 52 is physically secured in a suitable, thermally conductive manner to the base member 56 and to each of the porous elements 61, for example by vacuum brazing. The base member 56 has a plurality of radial openings 63 drilled therein, each of the openings 63 extending through a respective one of the radial ribs 58. Each of the radial openings 63 has therein a respective heat pipe, one of which is shown at 64. The heat pipes 64 are commercially available devices, and may for example be a heatpipe available as DYNATHERM 0476-1000 from Dynathern Corporation of Hunt Valley, Md. The heat pipes 64 are each surrounded within the associated opening 63 by a suitable thermal grease or thermal epoxy, which is not illustrated. In this regard, the disclosed embodiment uses a thermally conductive epoxy, which should be a non-degassing or low degassing epoxy, such as that available commercially from Dow Corning Corporation of Midland, Mich., as DOW CORNING 3140, MIL-A-46146 RTV Coating.

The antenna unit 12 includes four beam steering modules, one of which is visible at 71. Each of the beam steering modules 71 carries electronic circuitry, and may alternatively be referred to as a carrier. Each module 71 has a microprocessor on it, as well as other digital circuitry that facilitates steering of a respective one of the four beams which are each associated with a respective one of the four RF connectors 26.

The antenna unit 12 also includes a plurality of RF modules, one of which is designated by reference numeral 72. In the disclosed embodiment, the number of RF modules 72 is one-half the number of antenna elements 23. The beam steering module 71 and the RF module 72 each have approximately the same physical configuration. Accordingly, the physical structure of only one of the modules 71 and 72 is described in detail below.

Figure 2:
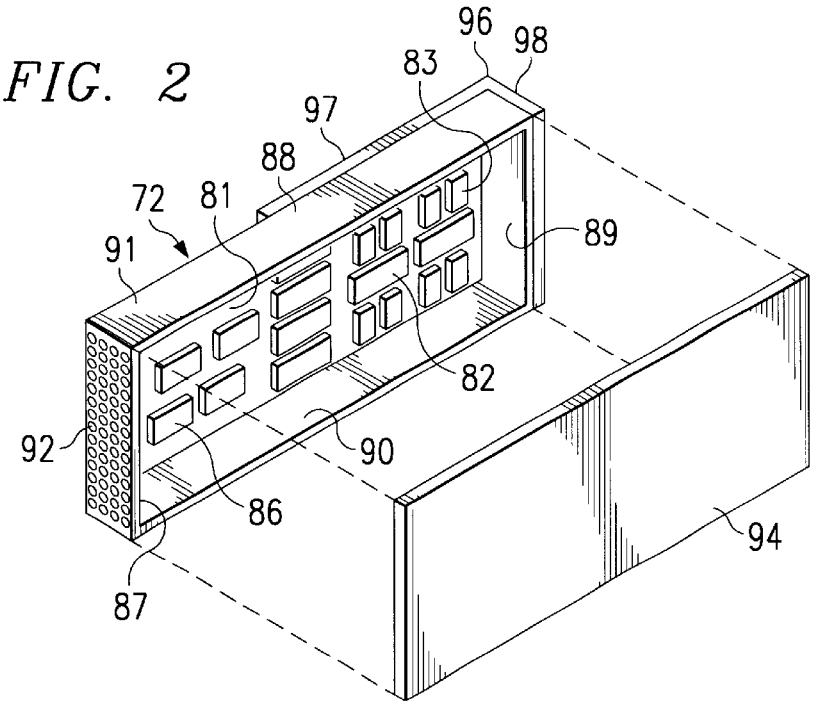
FIG. 2 is a diagrammatic exploded perspective view of a module which is a component of the antenna system of FIG. 1.

More specifically, FIG. 2 is a diagrammatic exploded perspective view of one of the RF modules 72 from the antenna unit 12 in FIG. 1. The module 72 includes a circuit board 81, which carries various electrical components. The end of the circuit board 81 nearest the cooling section 51 (FIG. 1) has a plurality of monolithic microwave integrated circuits (MMICS). These are high power components, which generate a substantial amount of heat. The MMICs 82 carry out functions such as implementing phase shifts in RF signals, amplifying RF signals, and effecting associated logic functions. The same end of the circuit board 81 has some additional integrated circuits 83, which provide control and support for the MMICs 82.

The opposite end of the circuit board 81 has several circuits 86 which, in the disclosed embodiment, are circuits of a type commonly known as circulators. The disclosed embodiment uses circulators 86 because the antenna unit 12 of the disclosed embodiment has the capability to both transmit and receive electromagnetic signals through the antenna elements 23. On the other hand, the present invention could be used in an antenna unit which was configured only to send or only to receive signals, and in that case the circulators 86 could be replaced with components commonly known as isolators.

The module 72 further includes a rectangular frame 91, which includes four wall portions 87, 88, 89 and 90. It would be possible for the circuit board and frame 91 to be formed as an integral unit. In the disclosed embodiment, however, this is not the case. In particular, the circuit board 81 is formed by starting with a flat plate of a material such as berillium oxide, which is thermally conductive but electrically non-conductive. Multiple layers of thick film conductors and insulators are then printed thereon, using known techniques. Through holes are then drilled or laser cut, and subsequently filled with a conductive material, in order to make electrical connections between the layers. The various integrated circuits, including those at 82–83 and 86 are then soldered in place on the board 81.

In a similar manner, the wall portion 87 is a circuit board formed by starting with a flat plate of a material such as glass or a ceramic. Multiple layers of thick film conductors and insulators are then printed on. Through holes are then drilled or laser cut, and subsequently filled with a conductive material, in order to make electrical connections between the layers. The wall portion 87 has on the outer side thereof a plurality of approximately hemispherical metal "ball" elements 92, which are collectively referred to as a ball grid interface. The elements 92 are each soldered to a respective pad provided on the outer surface of the wall portion 87, using a high-temperature solder which will not melt during subsequent soldering operations. At least some of these pads are electrically coupled to the conductors within the wall portion 87. In the disclosed embodiment, about twenty of the pads are coupled to conductors within the wall portion 87. The circuit board 81 and wall portion 87 are then mechanically coupled to each other, for example by an appropriate brazing technique.

Figure 3:
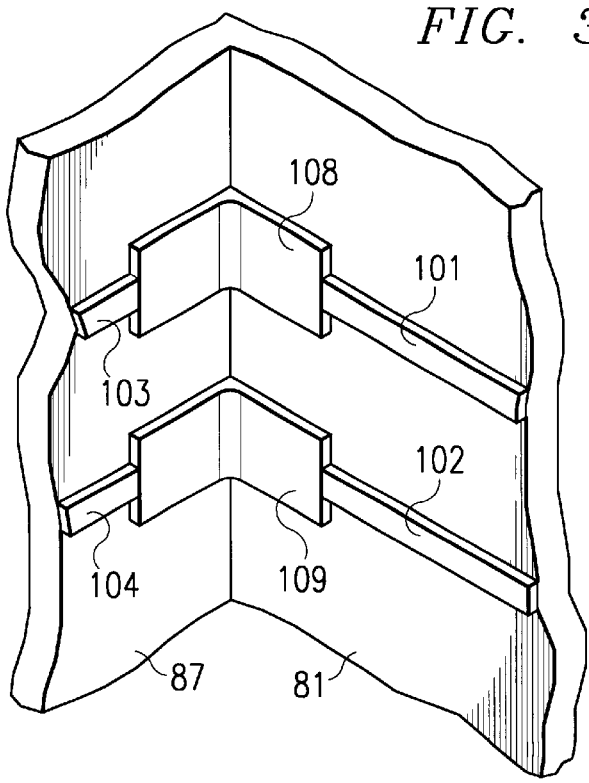
FIG. 3 is a diagrammatic fragmentary perspective view of a portion of the module of FIG. 2.

FIG. 3 is a diagrammatic fragmentary perspective view of a portion of the circuit board 81 and the wall portion 87 after they have been coupled together. The circuit board 81 has on the surface thereof a plurality of conductive strips, two of which are shown at 101 and 102. The conductive strips 101 and 102 are each coupled to conductors within the circuit board 81, and each extend to a location adjacent the end of circuit board 81 nearest wall portion 87. Similarly, the wall portion 87 has on the inner surface thereof a plurality of conductive strips, two of which are shown at 103 and 103. The conductive strips 103 and 104 are each coupled to conductors within the wall portion 87, and each extend to a location thereon adjacent the circuit board 81. A thin rectangular conductive ribbon element 108 is bent to an L-shape, and has each end soldered to a respective one of the strips 101 and 103, using a high temperature solder that will not melt during subsequent soldering. A similar ribbon element 109 has each end soldered to a respective one of the strips 102 and 104, using a high temperature solder. The ribbon element 108 thus electrically couples the strips 101 and 103, and the ribbon element 109 electrically couples the strips 102 and 104. Alternatively, the elements 108 and 109 could be thin rectangular gold ribbons welded to 101 and 103 and to 102 and 104, respectively.

The other three wall portions 88–90 of the frame 91 do not have conductors therein. In the disclosed embodiment, each is made of a ceramic or metal material, and they are each brazed to the circuit board 81 and to the edges of two other immediately adjacent wall portions. A platelike metal lid 94 has its edges each brazed or laser welded to an edge of a respective one of the wall portions 87 to 90, in order to hermetically seal the integrated circuits within the module 72. The lid is attached when the module 72 is in a dry nitrogen atmosphere, so that there is no air or moisture trapped within the module 72. As an alternative approach, the lid 94 can optionally be omitted and the integrated circuits can be coated with a sealant that hermetically seals them.

The module 72 further includes an L-shaped element 96, which has a high thermal conductivity. In the disclosed embodiment, the element 96 is made of a graphite material, but some other material with a high thermal conductivity would also be suitable. The L-shaped element 96 has two legs 97 and 98. The leg 97 is disposed against the back side of a portion of the circuit board 81, in particular the portion which has thereon the MMICs 82 and the control components 83. The leg 97 is fixedly secured to the circuit board 81 by a layer of a not-illustrated thermal epoxy which is disposed therebetween, and which helps to maximize the transfer of heat from the circuit board 81 to the leg 97. A suitable thermal epoxy is the epoxy discussed above in association with the heat pipes 64. The other leg 98 of the element 96 is disposed against the outer side of the end of the frame 91 opposite from the ball elements 92.

After the module 72 has been assembled, each of the ball elements 92 is soldered to a respective not-illustrated pad that is provided on a side of the circuit board 21 opposite from the antenna elements 23. This provides electrical connections between the circuit board 21 and the integrated circuits in the module 72, and also mechanically supports the module 72 on the circuit board 21.

The outer surface of the leg 98 of the L-shaped element 96 is in contact with, or at least closely adjacent, the face plate 52 of the cooling section 51. As mentioned above, the housing 37 is made of a material having a low coefficient of thermal expansion. This helps to minimize the extent to which the housing 37 will tend to move the cooling section 51 toward or away from the circuit board 21, and thus toward or away from the leg 98 of the element 96.

A material such a thermal grease or a thermal epoxy may be provided between the leg 98 and the cooling section 51, in order to maximize the transfer of heat from the leg 98 to the cooling section 51. The disclosed embodiment uses a thermal epoxy, such as the epoxy discussed above in association with the heat pipes 64. Use of a thermal epoxy has the added benefit of fixedly securing the leg 98 to the cooling section 51, which helps to physically support the modules 71 and 72, so that they are not supported solely by the solder connections to the ball elements 92 provided at the opposite end thereof.

During operation of the antenna system of FIG. 1, the MMICs 82 (FIG. 2) on the modules 72 generate a substantial amount of heat while the antenna system is operating. This heat is transferred rapidly and directly through legs 97 and 98 of the element 96 to the cooling section 51. The antenna unit 12 of FIG. 1 is intended for use in a satellite, in a situation where the antenna unit is intermittently operated and idle. When the antenna unit is operational, the cooling section 51 continuously absorbs heat from the circuitry and therefore begins to heat up. The not-illustrated phase change material in the recesses 57 absorbs the heat, and in the process changes phase by melting so as to change from a solid to a liquid. When the antenna unit 12 is thereafter turned off, the cooling unit slowly discharges the heat which it absorbed, such that the phase change material cools off and changes phase back to its original state, for example by changing from a liquid to a solid. In some other application, where the antenna unit 12 had to be operated continuously, or at least for long periods of time, the disclosed cooling section 51 could be replaced with a different type of cooling section, which is capable of effecting continuous cooling, examples of which are a convection cooling arrangement such as a heat sink, a liquid cooled arrangement, or a conduction cooling arrangement.

The present invention provides a number of technical advantages. One such advantage is that the disclosed antenna unit is relatively thin in comparison to traditional antenna units that have an array slat configuration. It has a smaller physical volume, lower weight, and lower cost than the traditional array slat configuration. A further advantage, in comparison to ultra-thin antenna units, is that RF circulators and/or isolators can be used between the RF power output amplifiers and the antenna elements, thereby permitting the system to both send and receive signals. Another advantage is that the antenna unit can provide multiple beam capability within the transverse size limits defined by the antenna element array, which is difficult with existing antenna units of ultra thin configuration, which are commonly referred to as tile arrays.

Still another advantage is that putting the cooling section at the very rear of the antenna unit allows both the RF circuit packaging and the cooling system to be optimized separately and independently of each other. Yet another advantage is that putting circuitry on the modules, rather than on the main circuit board, reduces problems due to different coefficients of thermal expansion. Consequently, the disclosed antenna system is capable of operation at relatively high frequencies, such as 80 GHz, while keeping thermal gradients within the circuitry low so that there is no need for the complexity and cost of providing extra circuitry in order to effect phase error compensation. Still another advantage is that the length of most RF conductors is less than in pre-existing antenna units having the traditional array slat configuration.

Although one embodiment has been illustrated and described in detail, it should be understood that various substitutions and alterations can be made thereto without departing from the invention. For example, the disclosed embodiment has a cooling section which uses phase change technology, but it will be recognized that various other types of cooling sections could also be used. As another example, the antenna elements in the disclosed embodiment are patch elements fabricated directly on the main circuit board, but other types of antenna elements could alternatively be used, such as a configuration of waveguide elements. As still another example, the modules of the disclosed embodiment are electrically coupled to the main circuit board by solder connections between the circuit board and an array of ball elements, but it will be recognized that there are other ways in which the modules and circuit board could be electrically coupled.

Still another example is that each of the modules in the disclosed embodiment includes an L-shaped element which is made of material with a high thermal conductivity, in order to facilitate the transfer of heat from the module to the cooling section. However, it will be recognized that there are other physical configurations which could facilitate a heat transfer from the modules to the cooling section. Yet another example involves the fact that the disclosed antenna unit has a multi-beam capability, but it will be recognized that the invention can be utilized in antenna units configured with single beam capability. Other substitutions and alterations are also possible without departing from the spirit and scope of the present invention, as defined by the following claims.

What is claimed is:

1. An apparatus, comprising:

an electrical interconnection section which is thin and generally planar;

an antenna section which is disposed on one side of said interconnection section, and which includes a plurality of antenna elements that are each electrically coupled to said interconnection section;

a cooling section which is spaced from said interconnection section on a side thereof opposite from said antenna section; and a module which is disposed between said interconnection section and said cooling section, which has a circuit board extending approximately perpendicular to said interconnection section, which has electronic components on said circuit board, which includes a first portion operative to electrically couple said electronic components to said interconnection section, and which includes a second portion operative to transfer to said cooling section the heat emitted by said electronic components.

2. An apparatus according to claim 1, wherein said second portion includes a heat transfer member which has portions respectively adjacent said electronic components and said cooling section.

3. An apparatus according to claim 1, wherein said module has a plurality of electrical conductors electrically coupled to said electronic components; wherein said module includes an arrangement which is cooperable with said circuit board to hermetically seal said electronic components within said module, said arrangement including a frame sealingly coupled to said circuit board and extending around said electronic components thereon, and including a lid sealingly coupled to a side of said frame opposite from said circuit board; and wherein said first portion of said module includes a wall portion of said frame that has a plurality of conductors electrically coupled to said interconnection section and includes conductive elements which each electrically couple a respective one of said conductors of said wall portion to a respective one of said conductors of said circuit board.

4. An apparatus according to claim 3, wherein said interconnection section includes a further circuit board, and wherein said first portion of said module includes said wall portion having a plurality of connection elements which are each electrically coupled to a respective said conductive element thereon, and which are each soldered to said further circuit board.

5. An apparatus according to claim 1, wherein said interconnection section includes a further circuit board, and wherein said first portion includes said module having at an end thereof adjacent said circuit board a plurality of connection elements which are each soldered to said further circuit board.

6. An apparatus according to claim 1, including a plurality of further modules which are each disposed between said interconnection section and said cooling section, which each have electronic components thereon, which each include a first portion operative to electrically couple said electronic components thereon to said interconnection section, and which each include a second portion operative to transfer to said cooling section the heat emitted by said electronic components thereon.

7. An apparatus according to claim 6, wherein said modules are spaced a substantial distance from each other.

8. An apparatus according to claim 1, wherein said electronic components include circuitry which causes said antenna section to function in a multi-beam mode that includes use by said antenna section of at least four separate beams.

9. An apparatus according to claim 8, wherein said electronic components include one of an RF circulator and an RF isolator.

10. An apparatus according to claim 9, wherein said antenna section can both send and receive electromagnetic signals through said antenna elements, and wherein said electronic components include monolithic microwave integrated circuits.

11. An apparatus according to claim 8, wherein said electronic components include a plurality of parts which are each one of an RF circulator and an RF isolator, and which are each associated with a respective one of said beams.

12. An apparatus according to claim 1, including an annular housing which extends between and is coupled to each of said interconnection section and said cooling section, said module being disposed within said housing.

13. An apparatus according to claim 12, wherein said housing is made of a material having a low coefficient of thermal expansion.

14. An apparatus according to claim 1, wherein said interconnection section includes a multi-layer circuit board.

15. An apparatus according to claim 14, wherein said antenna elements of said antenna section are patch antenna elements formed directly on said multi-layer circuit board.

16. An apparatus according to claim 14, wherein said multi-layer circuit board has at least one connector for radio frequency signals, control signals, and power.

17. An apparatus according to claim 1, wherein said cooling section includes a thermally conductive member cooperable with said second portion, and includes a phase change material disposed on a side of said thermally conductive member opposite from said second portion of said module.

18. A method of operating an antenna system which includes a thin and generally planar electrical interconnection section and a plurality of antenna elements disposed on one side of and electrically coupled to said interconnection section, comprising the steps of:

providing on a side of said interconnection section opposite from said antenna elements a module having a circuit board with electronic components thereon;

orienting said circuit board to extend approximately perpendicular to said interconnection section;

transmitting electrical signals between said interconnection section and said electronic components; and transferring heat emitted by said electronic components to a cooling section which is disposed on a side of said module remote from said interconnection section.

19. A method according to claim 18, further including the steps of:

providing between said interconnection section and said cooling section a plurality of further modules which each have a circuit board with electronic components thereon;

orienting said circuit boards of said further modules to extend approximately perpendicular to said interconnection section;

positioning said modules so that they are spaced a substantial distance from each other;

transmitting electrical signals between said interconnection section and said electronic components on each of said further modules; and transferring heat emitted by said electronic components on each of said further modules to said cooling section.

20. An apparatus, comprising:

an electrical interconnection section which is thin and generally planar;

an antenna section which is disposed on one side of said interconnection section, and which includes a plurality of antenna elements that are each electrically coupled to said interconnection section;

a cooling section which is spaced from said interconnection section on a side thereof opposite from said antenna section; and a module which is disposed between said interconnection section and said cooling section, which has electronic components thereon, which includes a first portion operative to electrically couple said electronic components to said interconnection section, and which includes a second portion operative to transfer to said cooling section the heat emitted by said electronic components;

wherein said second portion includes a heat transfer member which has portions respectively adjacent said electronic components and said cooling section;

wherein said module includes a circuit board which extends approximately perpendicular to said interconnection section and has said electronic components thereon; and wherein said heat transfer member is an L-shaped member having a first leg which is disposed against a portion of said circuit board with said electronic components thereon, and having a second leg which is disposed adjacent a surface portion of said cooling section.

21. An apparatus according to claim 20, wherein said heat transfer member is made of a graphite-based material.

22. An apparatus, comprising:

an electrical interconnection section which is thin and generally planar;

an antenna section which is disposed on one side of said interconnection section, and which includes a plurality of antenna elements that are each electrically coupled to said interconnection section;

a cooling section which is spaced from said interconnection section on a side thereof opposite from said antenna section; and a plurality of modules which are each disposed between said interconnection section and said cooling section, which are spaced a substantial distance from each other, which each have electronic circuitry thereon, which each include a first portion operative to electrically couple said electronic components thereon to said interconnection section, and which each include a second portion operative to transfer to said cooling section the heat emitted by said electronic components thereon;

wherein each said module includes a circuit board which extends approximately perpendicular to said interconnection section and has said electronic components thereon; and wherein each said module includes a heat transfer member which is an L-shaped member having a first leg disposed against a portion of said circuit board with said electronic components thereon, and having a second leg disposed adjacent a surface portion of said cooling section.

23. An apparatus, comprising:

an electrical interconnection section which is thin and generally planar;

an antenna section which is disposed on one side of said interconnection section, and which includes a plurality of antenna elements that are each electrically coupled to said interconnection section;

a cooling section which is spaced from said interconnection section on a side thereof opposite from said antenna section; and a plurality of modules which are each disposed between said interconnection section and said cooling section, which are spaced a substantial distance from each other, which each have electronic circuitry thereon, which each include a first portion operative to electrically couple said electronic components thereon to said interconnection section, and which each include a second portion operative to transfer to said cooling section the heat emitted by said electronic components thereon;

wherein each said module includes a circuit board which extends approximately perpendicular to said interconnection section, which has thereon said electronic components of the module, and which has a plurality of electrical conductors electrically coupled to the electronic components;

wherein each said module includes an arrangement which is cooperable with the circuit board thereof to hermetically seal said electronic components thereon within said module, said arrangement including a frame sealingly coupled to the circuit board and extending around said electronic components thereon, and including a lid sealingly coupled to a side of the frame opposite from the circuit board; and wherein said first portion of each said module includes said frame therefor having a wall portion that has a plurality of conductors electrically coupled to said interconnection section, and includes conductive elements which each electrically couple a respective one of the conductors of the wall portion thereof to a respective one of the conductors of the circuit board thereof.

24. An apparatus according to claim 23, wherein said interconnection section includes a further circuit board, and wherein said first portion of each said module includes said wall portion thereof having a plurality of connection elements which are each electrically coupled to a respective said conductive element thereon, and which are each soldered to said further circuit board.

25. An apparatus, comprising:

an electrical interconnection section which is thin and generally planar;

an antenna section which is disposed on one side of said interconnection section, and which includes a plurality of antenna elements that are each electrically coupled to said interconnection section;

a cooling section which is spaced from said interconnection section on a side thereof opposite from said antenna section;

a plurality of modules which are each disposed between said interconnection section and said cooling section, which are spaced a substantial distance from each other, which each have electronic circuitry thereon, which each include a first portion operative to electrically couple said electronic components thereon to said interconnection section, and which each include a second portion operative to transfer to said cooling section the heat emitted by said electronic components thereon; and an annular housing which extends between and is coupled to each of said interconnection section and said cooling section, each said module being disposed within said housing.

26. An apparatus according to claim 25, wherein said housing is made of a material having a low coefficient of thermal expansion.

* * * * *